US010119397B2

(12) United States Patent
Shaobin

(10) Patent No.: US 10,119,397 B2
(45) Date of Patent: Nov. 6, 2018

(54) PUSHING SITTING DEVICE

(71) Applicant: Wang Shaobin, Xi'an Province (CN)

(72) Inventor: Wang Shaobin, Xi'an Province (CN)

( * ) Notice: Subject to any disclaimer, the term of this patent is extended or adjusted under 35 U.S.C. 154(b) by 425 days.

(21) Appl. No.: 14/933,549

(22) Filed: Nov. 5, 2015

(65) Prior Publication Data

US 2016/0123143 A1 May 5, 2016

(30) Foreign Application Priority Data

Nov. 5, 2014 (CN) ..... 2014 1 0617250

(51) Int. Cl.
*E21B 49/10* (2006.01)

(52) U.S. Cl.
CPC ..... *E21B 49/10* (2013.01)

(58) Field of Classification Search
CPC .... E21B 49/10; E21B 49/088; E21B 17/1014; E21B 17/1021; E21B 17/1078
See application file for complete search history.

(56) References Cited

U.S. PATENT DOCUMENTS 1,898,074 A * 2/1933 Bailey ..... E21B 17/1021 15/104.061
2,262,655 A * 11/1941 Seale ..... E21B 49/10 166/100
2,971,582 A * 2/1961 Marsh ..... E21B 17/1021 166/241.5
3,167,707 A * 1/1965 Oliver ..... E21B 17/1021 175/50
3,177,938 A * 4/1965 Roussin ..... E21B 17/1021 166/104
3,217,804 A * 11/1965 Peter ..... E21B 49/10 166/100
3,568,053 A * 3/1971 Kilpatrick ..... E21B 17/1021 324/325
3,977,468 A * 8/1976 Brewer ..... E21B 17/1021 166/241.5
4,432,143 A * 2/1984 Moriarty ..... E21B 17/1021 250/268
RE32,070 E * 1/1986 Vezin ..... E21B 17/1021 250/268
5,092,423 A * 3/1992 Petermann ..... E21B 17/1021 181/102
5,358,040 A * 10/1994 Kinley ..... E21B 17/1021 166/241.3

(Continued)

*Primary Examiner* — James G Sayre
(74) *Attorney, Agent, or Firm* — Grogan, Tuccillo & Vanderleeden LLP

(57) ABSTRACT

A pushing sitting device includes a main base, at least one set of pushing arms are provided on the side surface of the main base. The pushing arm includes a bi-parallelogram, having a first parallelogram structure and a second parallelogram structure. The first parallelogram structure includes a front arm, a detector assembly, an assisting arm and the main base, wherein the front arm is connected to the detector assembly and the main base respectively through joint pins at two ends, while the assisting arm is connected to the detector assembly and the main base respectively through the rotating shafts at two ends. The second parallelogram includes a rear arm, the detector assembly, a nonporous assisting arm and the main base which are connected in sequence by connecting shaft.

10 Claims, 7 Drawing Sheets

(56) References Cited

U.S. PATENT DOCUMENTS

| | | | | |
|---|---|---|---|---|
| 5,785,125 | A * | 7/1998 | Royer | E21B 17/1021 166/241.1 |
| 5,979,550 | A * | 11/1999 | Tessier | E21B 23/04 166/206 |
| 2001/0035289 | A1* | 11/2001 | Runia | E21B 49/10 166/66 |
| 2003/0183383 | A1* | 10/2003 | Guerrero | E21B 17/1021 166/206 |
| 2004/0031606 | A1* | 2/2004 | Xu | E21B 17/1021 166/213 |
| 2007/0181298 | A1* | 8/2007 | Sheiretov | E21B 4/18 166/212 |
| 2007/0227736 | A1* | 10/2007 | Sheiretov | E21B 17/1021 166/301 |
| 2008/0217067 | A1* | 9/2008 | Ge | E21B 19/00 175/85 |
| 2012/0048542 | A1* | 3/2012 | Jacob | E21B 17/1021 166/254.2 |
| 2012/0205093 | A1* | 8/2012 | Paszek | E21B 17/1021 166/241.6 |
| 2016/0053612 | A1* | 2/2016 | Proett | E21B 49/10 166/264 |
| 2018/0003027 | A1* | 1/2018 | Donzier | E21B 17/1021 |

* cited by examiner

PUSHING SITTING DEVICE

CROSS REFERENCE TO RELATED APPLICATION

This application claims the benefit of Chinese Patent Application Serial No. CN201410617250, filed on Nov. 5, 2014, herein incorporated by reference in its entirety.

FIELD OF THE INVENTION

The present application refers to an exploration tool used in the oil sector, in particularly, refers to a pushing sitting device used for exploring the fluid pressure at lower strata and for taking sample from lower strata.

BACKGROUND OF THE INVENTION

During the oil production, the fluid pressure is needed to be measured and the sample of the fluid from the lower strata is also needed to be taken for locating the oil layer accurately and facilitating the production of the oil.

At present, the tools sold in the market for measuring the fluid pressure at lower strata and for sample taking are provided with detectors driven by piston system, the main disadvantage of these tools are that the contacting area between the detector and the strata is so small that the device cannot enter or leave the well smoothly, leading to the device stuck in the well easily; meanwhile, the detectors are not able to get in touch with the wall of the well uniformly along the circumference, and are not able to control the load exerted on the wall.

SUMMARY OF THE INVENTION

The present application provides a pushing sitting device that is able to get in touch with the wall of the oil well uniformly.

In order to achieve the aforesaid object, the pushing sitting device of the present invention is provided with the following structure: a pushing sitting device used for the oil exploration and sample taking, includes a main base, at least one set of pushing arms are provided on the side surface of the main base. Each set of pushing arm consists of a bi-parallelogram containing a first parallelogram structure and a second parallelogram structure. The first parallelogram includes a front arm, a detector assembly, an assisting arm and the main base, wherein the front arm is connected to the detector assembly and the main base respectively through joint pins at two ends, while the assisting arm is connected to the detector assembly, the main base respectively through rotating shafts at two ends. The second parallelogram is structured by a rear arm, the detector assembly, a no-hole assisting arm and the main base are connected by connecting shaft.

Furthermore, one or more front piston holes are provided in the left side of the main base corresponding to pushing arm, each piston hole corresponds to a main pushing piston; one or more piston holes are connected to each other through a first internal hole (the high pressure for the stretching of the first parallelogram structure) which is sealed by seal plug and thread screw plug, the internal hole (the high pressure oil hole for the stretching of the first parallelogram structure) is used for the injection of the high pressure oil, one or more main pushing pistons move horizontally at the same time under the pushing of the high pressured oil, which drive the corresponding pushing arms to move and stretch till the detector assembly get in touch with the wall of the oil well.

Furthermore, one or more cylinder bores corresponding to the pushing arms are provided at the right side of the main base, each cylinder bore corresponds to an assisting pushing piston rod, one or more cylinder bores are connected to each other by the internal passage (the high pressure oil passage for the stretching of the second parallelogram structure) arranged inside the main base, the internal passage (the high pressure oil passage for the stretching of the second parallelogram structure) sealed by seal plug and thread plug is used for the injection of the high pressure oil; three cylinder bores are also connected by the internal channel (the high pressure oil channel for taking back the pushing arms) inside the main base, which is used for the circulation of the high pressured oil, thus taking the pushing arms back, the internal channel is sealed by the seal plug and thread plug for increasing the pressure of the high pressured oil.

Furthermore, the tube of the pressured oil for taking the arms back is injected with the high pressured oil, increasing the pressure on the high pressured oil and decreasing the pressure of high pressured oil (the first high pressure for the stretching of the arms) and high pressured oil (the second pressured oil for stretching arms) till 0 psi; under the pressure from high pressured oil (for taking the pushing arms back), the assisting pushing piston rods move horizontally towards the right direction, which drives the rear connecting bar to move, and then drives the rear pushing arm to rotate with respect to the connecting shaft, then drives the detector assembly to move vertically till it is taken back to the slot.

Furthermore, the detector assembly in each pushing arm includes a detector and a rubber pad press fitted thereon; the area and the shape of the rubber pad can be equal to or smaller than the area of the detector, the shape can be rectangle shaped or round shaped; the detector assembly with the press fitted rubber pad is provided with a fluid opening which can be rectangle, round or square; a filter net is fixed on the fluid opening by bolt.

Furthermore, the detector assembly may include the metal plate, the rubber pad is press fitted to both sides of the metal plate, the metal plate is fixed on the detector by the bolt, meanwhile, the filter net is fixed on the rubber pad by the bolt too.

Furthermore, during the oil exploration and production, the detector assembly is able to press the rubber pad on the wall of the well for separating the mixture flow from the well surface, the formation fluid connects the mixture flow, the mixture flow can go through the internal bore inside the detector, the internal bore of the assisting arm and the internal bore of the main base, these components are connected in sequence; the internal bore is sealed by the seal plug and the seal ring; at the end, the formation fluid enters into the internal bore of the main base, then enters into the tube connected to the detector.

Furthermore, a Sakae Linear-Motion Potentiometer is provided in the main pushing piston system for measuring the moving distance of the detector assembly in vertical direction.

Furthermore, a locating key is set on the main base close to the main pushing piston for locating the main pushing piston.

Furthermore, three pushing arms are provided on the side surface of the main base of the pushing sitting device.

The pushing sitting device with above mentioned structure can get in touch with the wall of the well uniformly, and also is able to control the loads exerted on the wall of the well; meanwhile, the pushing sitting device with above mentioned structure can overcome the deficiencies in the prior art that the device is unable to be pulled out directly and get stuck easily in the oil well.

DETAILED DESCRIPTION OF THE PREFERRED EMBODIMENTS

In order to provide an easy understanding on the object and the function of the present application better, the structure and the operating process of an embodiment will be described in detail herein under the illustrating drawings.

In order to overcome the deficiencies in the prior art, the pushing sitting device used in the oil exploration with three arms of the embodiment includes, three pushing piston systems and a flow passage located in the left side of the main base 41, three six-bar mechanism and a flow passage which are located in the middle portion of the main base 41, another three pushing piston systems and a flow passage which are also located in the right side of the main base 41; the pushing device also includes a left guiding connector 4 and a right guiding connector 4.

Figure 1:
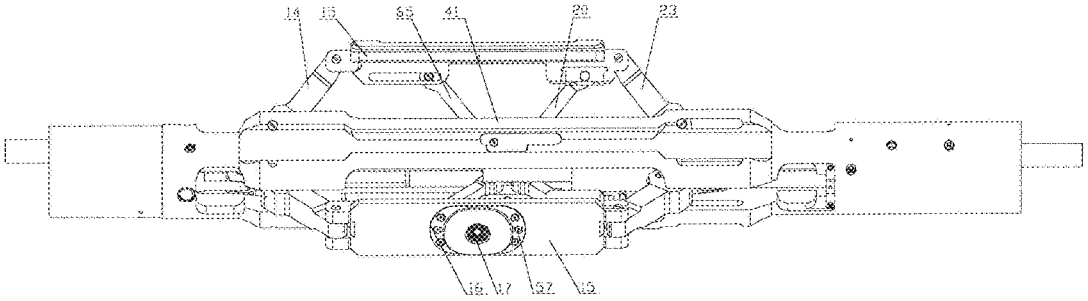
FIG. 1 is a front view of the pushing sitting device with three sets of pushing arms according to one embodiment.

As shown in FIG. 1, the pushing sitting device in the embodiment includes three sets of pushing arms that are provided axially on the side surface of the main base 41 uniformly; three pushing pistons are driven by a hydro cylinder; three pushing pistons can push three sets of arms respectively; the three sets of pushing arms drive said three detectors arranged on the arms respectively to attach to the wall of well without any mutual interferences.

Figure 2:
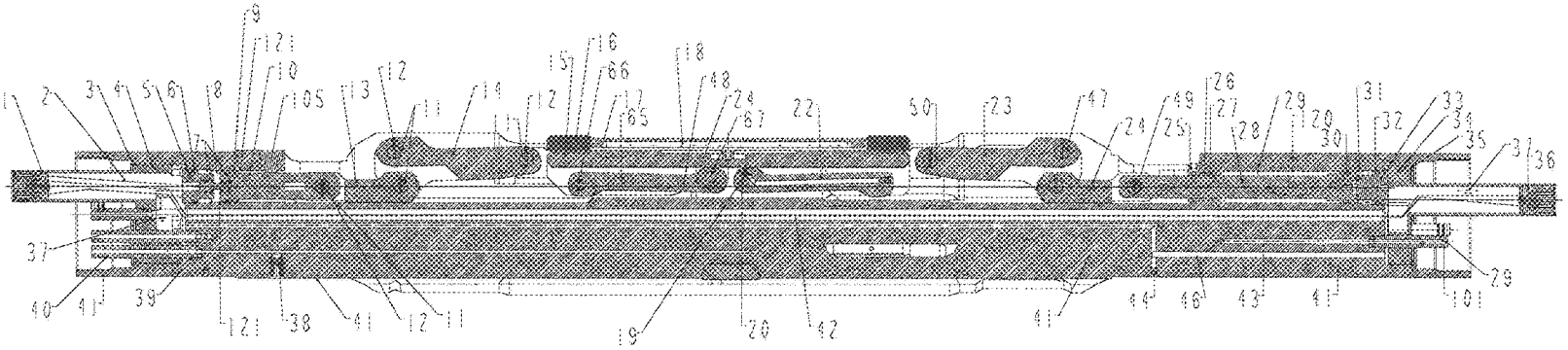
FIG. 2 is a sectional view of the pushing sitting device in FIG. 1, wherein the sets of arms are taken back.
Figure 3:
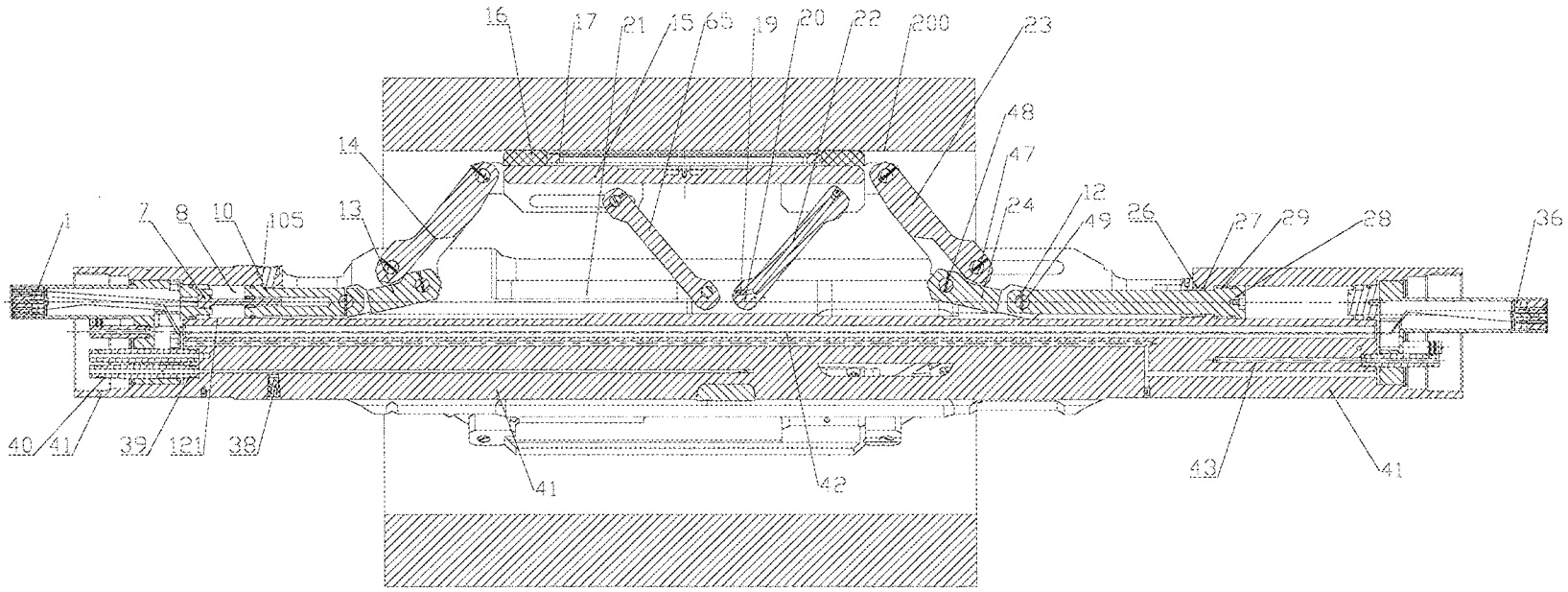
FIG. 3 is another sectional view of the pushing sitting device in FIG. 1, wherein the sets of arms are stretched out.
Figure 5:
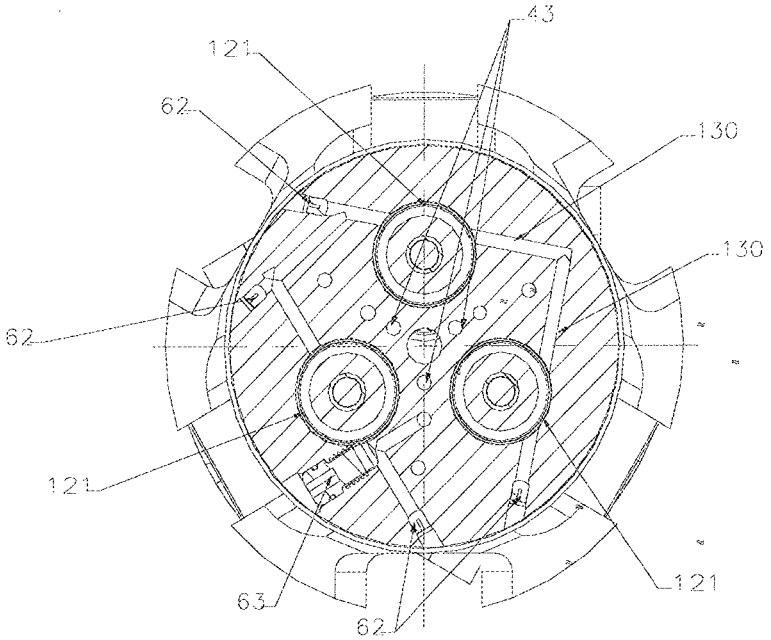
FIG. 5 is a cross sectional view of the pushing sitting device.
Figure 6:
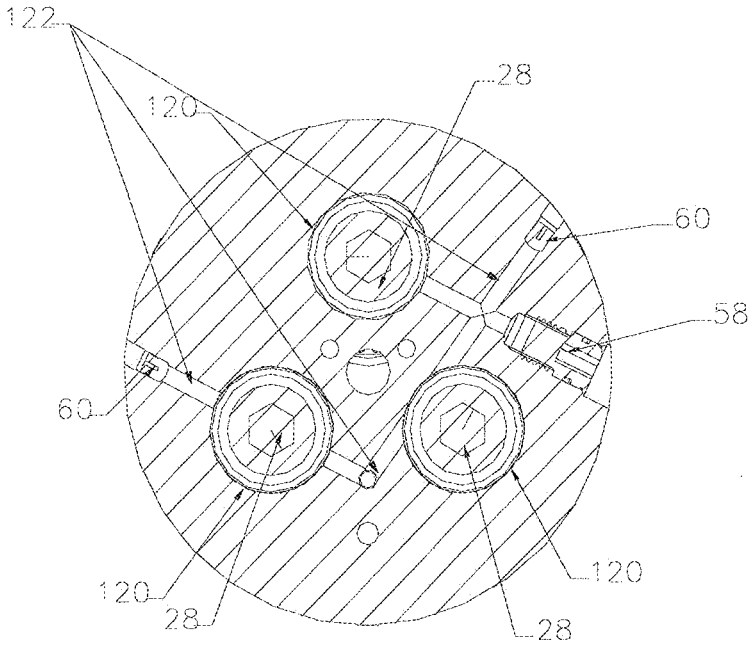
FIG. 6 is a cross sectional view of the pushing sitting device.
Figure 7:
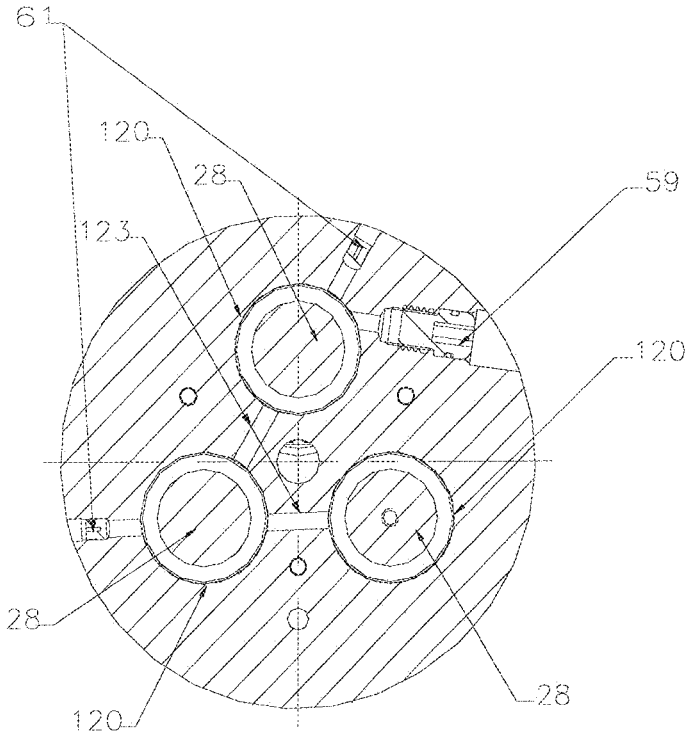
FIG. 7 is a cross sectional view of the pushing sitting device.

Specifically, as shown in FIGS. 2-3, each set of arm forms a bi-parallelogram structure, the first parallelogram consist of a front arm 14, a detector assembly 15, an assisting arm 20 and the main base 41, wherein the front arm 14 is connected to detector assembly 15 and the main base 41 respectively by means of joint pins 11 at two ends, while the assisting arm 20 is connected to detector assembly 15 and the main base 41 respectively by means of rotating shafts at two ends. The second parallelogram is structured by a rear arm 23, a detector assembly 15, a no-hole assisting arm 65, the main base 41 and connecting shaft (66, 67, 50, 47), in other words, the second parallelogram is structured by a rear arm 23, a detector assembly 15, a no-hole assisting arm 65, and the main base 41, which are connected in sequence by connecting shaft (66, 67, 50, 47). As shown in FIG. 2 and FIG. 5, three front piston holes 121 are provided in the left side of the main base 41 uniformly corresponding to three sets of pushing arms respectively, each piston hole 121 corresponds to each main pushing piston, as shown in FIG. 5; three front piston holes 121 are connected to each other through a first internal hole 130 sealed by seal plug 62 and thread screw plug 63, the internal 130 is used for the injection of the high pressure oil 8 (the first high pressure for the stretching of the arms). As shown in FIGS. 2, 6-7, three cylinder bores 120 are provided at the right side of the main base 41 correspondingly, each cylinder bore 120 corresponds to an assisting pushing piston rod 28, three cylinder bores 120 are connected to each other by the internal passage 123 arranged inside the main base 41, the internal passage 123 sealed by seal plug 60 and thread plug 59 is used for the injection of the high pressure oil 31 (the second pressured oil for stretching arms, FIG. 6). Three cylinder bores 120 are also connected by the internal channel 122 inside the main base 41, which is used for the circulation of the high pressured oil 29, thus taking the pushing arms back, the internal channel 122 is sealed by the seal plug 60 and thread plug 58 for increasing the pressure of the high pressured oil 29 (FIG. 7).

Figure 4:
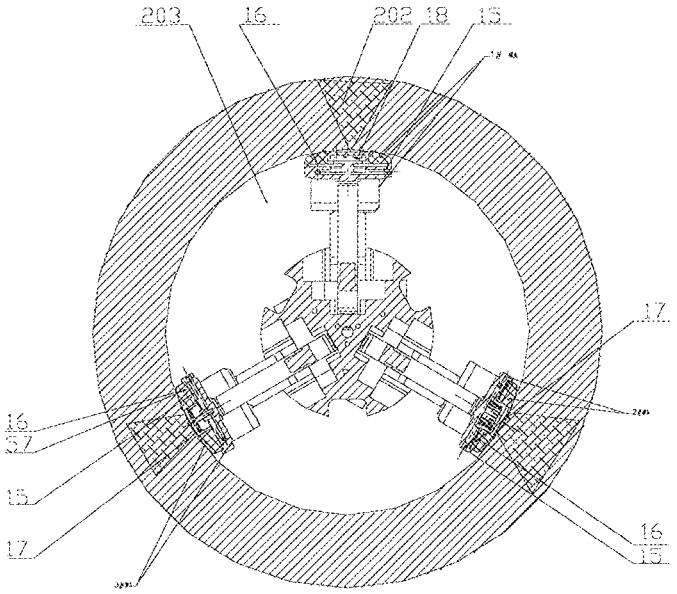
FIG. 4 is a cross sectional view of the pushing sitting device.

As shown in Figs. 2-4, during the process of expanding the pushing arms of the pushing sitting device, the three main pushing pistons 10 move horizontally at the same time under the pushing of the high pressured oil 8, meanwhile, drive three detector assemblies 15 respectively to move vertically till they attach to the wall 200 of the well (as shown in FIG. 3-4). Specifically, high pressured oil 8 pushes the main pushing piston to move horizontally, the front pushing arm 14 rotates under the traction of the connecting bar 13, and then drive the detector assembly l5 to move vertically till it attach to the wall 200 of the well, the main pushing piston 10, the connection bar 13, the front pushing arm 14 and the detector assembly 15 are connected in sequence by the connecting shaft (66, 67, 50, 47); a Sakae Linear-Motion Potentiometer 7 is provided in the main pushing piston system for measuring the moving distance of the detector assembly in vertical direction; a locating key 105 is set on the main base 41 close to the main pushing piston 10 for locating the main pushing piston. The detector 15 moves in a vertical direction, and drives the rear arm 23 to rotate with connecting shaft 47, and drives the rear connecting bar 24 to move via the connecting bar 48, and then drives the assisting pushing piston rod 28 to move horizontally via the connecting bar 49; the pushing piston rod is connected to the rear pushing arm by a rear connecting bar. Additionally, even though the second parallelogram structure works under the driving, during the expanding process of the pushing arms, the second parallelogram structure also bears the pushing power caused by the high pressured oil 31 in the internal passage 123, which also leads to the expanding of the detector assemblies 15, thus, the magnitude of the load exerted on the wall of the well lies on the force from the high pressured oil 8 and the high pressured oil 31, the force exerted on the wall 200 by the detector assemblies 15 will increase with increasing of the pressure of the high pressured oil 8 and the high pressured oil 31.

Figure 8A:
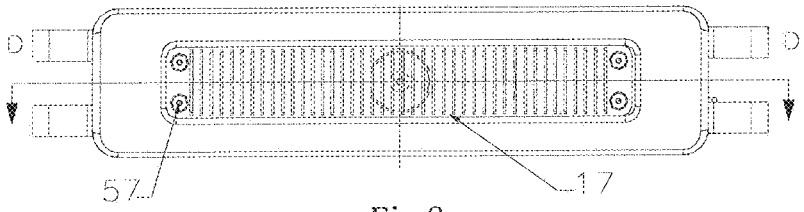
FIG. 8*a* and FIG. 8*b* are a top view and a front sectional view of the detector assembly respectively in the first embodiment.
Figure 8B:
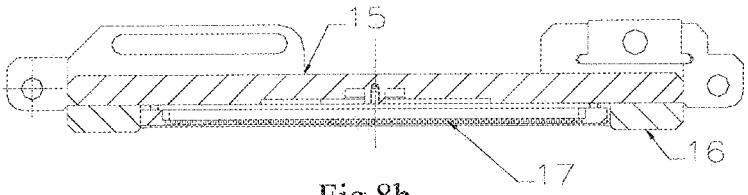

As shown in Figs. 2-4 and FIGS. 8*a* and 10*b*, the detector assembly 15 of the pushing sitting device in the present invention includes, at least one detector, a rubber pad 16, and a filter net 17; as shown in FIGS. 8*a* and 8*b*, the area and the shape of the rubber pad 16 can be equal to the detector, and the rubber pad 16 is press fitted to the detector, a rectangle shaped opening for the flow is provided on the detector and the rubber pad, a rectangle shaped filter net 17 is fixed on the opening of the detector and the rubber pad 16 by means of the bolt 57. The detector assembly 15 with the above said structure is able to press the rubber pad 16 on the wall 200 of the well for separating the mixture flow 18 from the well surface 203, the formation fluid 202 connects the mixture flow 18, the mixture flow 18 can go through the internal bore inside the detector 15, the internal bore 22 of the assisting arm 20 and the internal bore of the main base 41, which are connected in sequence; the internal bore is sealed by the seal plug 19 and the seal ring 80; and finally, the formation fluid 202 enters into the internal bore of the main base 41, then enters into the tube connected to the detector.

Figure 9A:
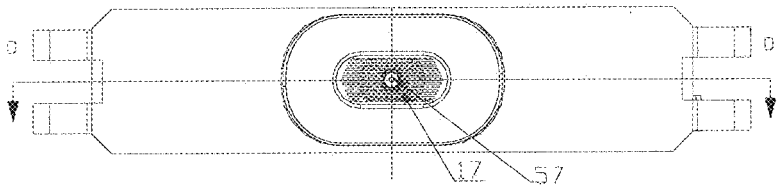
FIG. 9*a* and FIG. 9*b* are a top view and a front sectional view of the detector assembly respectively in the second embodiment.
Figure 9B:
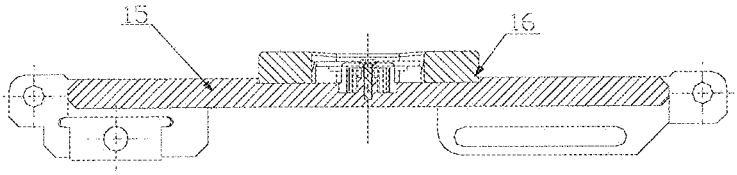
Figure 10A:
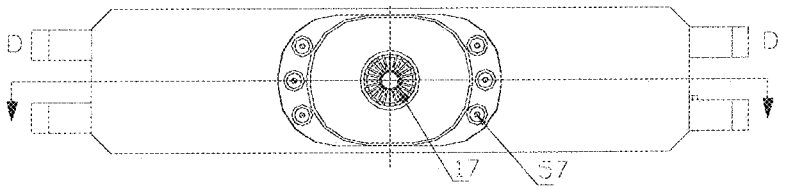
FIG. 10*a* and FIG. 10*b* are a top view and a front sectional view of the detector assembly respectively in the third embodiment.
Figure 10B:
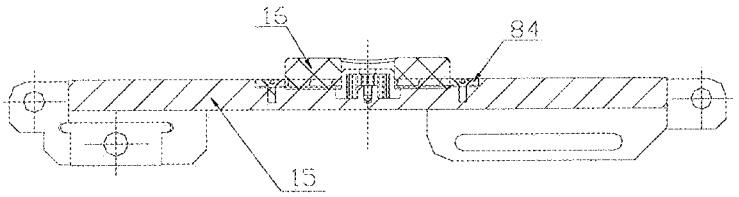

Furthermore, the rubber pad 16 of the detector assembly 15 can be smaller than the detector on the area with a proper shape. The rubber pad 16 on the detector assembly 15 in FIG. 9*a* is round square shape, the fluid opening thereof is round square shape too, the round square shape filter net is fixed on the fluid opening by bolt 57, meanwhile, the rubber pad 16 is also fixed on the detector by the bolt 57. Furthermore, the detector assembly 15 may include the metal plate 84, as shown in FIGS. 10*a* and 10*b*, the rubber pad 16 is press fitted to both sides of the metal plate, the metal plate 84 is fixed on the detector by the bolt 57, meanwhile, the filter net 17 is fixed on the rubber pad 16 by the bolt 57 too. The oil exploration and the obtaining the formation fluid through the foresaid detector assembly are the same on the theory. Moreover, if the pushing sitting device has multi-sets of pushing arms, detector assemblies on different arms can be different to one another or the same.

As shown in Figs. 2-3, during the process of taking the arms of the pushing sitting device back, the tube 101 of the pressured oil for taking the arms back is injected with the high pressured oil 29, increasing the pressure on the high pressured oil 29 and decreasing the pressure of high pressured oil 8 and high pressured oil 31 till 0 psi; under the pressure from high pressured oil 29, the assisting pushing piston rods 28 move horizontally towards the right direction, which drives the rear connecting bar 24 to move through connecting shaft 49, furthermore, drives the rear pushing arm 23 to rotate with respect to connecting shaft 47 through the connecting shaft 48, drives the detector assembly to move vertically till it is taken back to a slot 21 which is provided on the side of the main body for accommodating the detector; the high pressured oil 29 is sealed by seal ring 27, seal block and seal ring 26. All three cylinder bores 120 are connected by the internal channel 122 of the main base 41, the high pressured oil 29 are sealed by the seal plug 60, thread seal plug 58 for increasing the pressure thereof; three assisting pushing piston rods 28 move horizontally at the same time, which leads to the three detector assemblies move vertically and respectively at the same time till three detector assemblies are taken back to slots 21.

As for the pushing sitting device in the embodiment, three sets of pushing arms are arranged on the side surface of the main base uniformly, an angle of 120 degree is formed between neighboring arms. The quantity of the sets of the pushing arm arranged on the main base is not limited to be three, it can be one or more in practice, which depends on the status of the well and the needs of work. Moreover, multiple sets of pushing arms are not limited to be arranged on the main base uniformly, which can be flexible with different angles on the base of the well status.

As for the pushing sitting device in the present invention, as shown in FIG. 2, a left guiding connector 4 is provided on the left side of the main base 41, on which the multi-core connector 1 is mounted, and on the lower part of which a sealed connecting tube 40 is also provided. The multi-core connector 1 is connected to multi-core connector 36 of a right guiding connector 34 by an electric bus 42. Seven sealed connecting tubes are provided in the main base 41, respectively, a connecting tube of No. 1 detector, a connecting tube of No. 2 detector, a connecting tube of No. 3 detector, a connecting tube of pressured oil bus, a connecting tube of the returning oil, a connecting tube of the pressured oil of front piston, a connecting tube of the mixture fluid. Multiple internal channels 43 are arranged inside the main base 41, which bring the left connecting tube of pressured oil bus and the right connecting tube of pressured oil bus in connection, bring the left connecting tube of mixture fluid bus and the right connecting tube of mixture fluid in connection, and also bring the left connecting tube of oil returning bus and the right connecting tube of oil returning bus in connection.

While specific embodiment of the invention has been shown and described in detail to illustrate the application of the principle of the invention, it will be understood that the invention may be embodied otherwise without departing from such principles.

What is claimed:

1. A pushing sitting device for oil exploration and sample taking, comprises:

a main base, on a side surface of which at least one set of pushing arms are provided; each set of pushing arms include a bi-parallelogram that contains a first parallelogram structure and a second parallelogram structure; the first parallelogram structure includes a front arm, a detector assembly, an assisting arm and the main base, and wherein the front arm is connected to the detector assembly and the main base respectively via joint pins at two ends, while the assisting arm is connected to the detector assembly and the main base respectively via rotating shafts at two ends; the second parallelogram structure is constituted by a rear arm, the detector assembly, a nonporous assisting arm and the main base, the said components are connected to each other by a connecting shaft.

2. A pushing sitting device as claimed in claim 1, wherein one or more front piston holes are provided in the left side of the main base corresponding to pushing arm, each piston hole corresponds to a main pushing piston; one or more piston holes are connected to each other through a first internal hole sealed by a seal plug and a thread screw plug, the internal hole is used for the injection of high pressure oil, one or more main pushing pistons move horizontally at the same time under the pushing of the high pressured oil, which drive the corresponding pushing arms to move and stretch till the detector assembly contacts the wall of an oil well.

3. A pushing sitting device as claimed in claim 2, wherein, a Sakae Linear-Motion Potentiometer is provided in the main pushing piston system for measuring the moving distance of the detector assembly in a vertical direction.

4. A pushing sitting device as claimed in claim 2, wherein a locating key is set on the main base close to the main pushing piston for locating the main pushing piston.

5. A pushing sitting device as claimed in claim 1, wherein one or more cylinder bores corresponding to the pushing arms are provided at the right side of the main base, each cylinder bore corresponds to an assisting pushing piston rod, one or more cylinder bores are connected to each other by an internal passage arranged inside the main base, the internal passage sealed by a seal plug and a thread plug used for the injection of high pressure oil; three cylinder bores are also connected by the internal channel inside the main base for the circulation of the high pressured oil, thus taking the pushing arms back, the internal channel is sealed by the seal plug and thread plug for increasing the pressure of the high pressured oil.

6. A pushing sitting device as claimed in claim 5, wherein the high pressured oil for taking the arms back is injected into a tube which is provided by the main base, increasing the pressure on the high pressured oil and decreasing the pressure of high pressured oil and high pressured oil till 0 psi; under the pressure from high pressured oil, the assisting pushing piston rods move horizontally towards the right direction, which drives a rear connecting bar to move, and then drives the rear pushing arm to rotate with respect to the connecting shaft, then drives the detector assembly to move vertically till it is taken back to a slot which is provided on the side of the main base for accommodating the detector.

7. A pushing sitting device as claimed in claim 1, wherein the detector assembly in each pushing arm includes a detector, a rubber pad press fitted thereon; the area and the shape of the rubber pad can be equal to or smaller than the area of the detector, the shape can be a rectangle shape or round shape; the detector assembly with the press fitted rubber pad is provided with a fluid opening, a shape of which may be one of a rectangle, round, or square; a filter net is fixed on the fluid opening by a bolt.

8. A pushing sitting device as claimed in claim 7, wherein the detector assembly includes a metal plate, the rubber pad press fitted to both sides of the metal plate, the metal plate is fixed on the detector by the bolt, the filter net is fixed on the rubber pad by the bolt.

9. A pushing sitting device as claimed in claim 7, wherein the detector assembly presses the rubber pad on the wall of the well for separating the mixture flow from the well surface, the formation fluid connects the mixture flow, the mixture flow can go through the internal bore inside the detector, the internal bore of the assisting arm and the internal bore of the main base, which are connected in sequence; the internal bore is sealed by the seal plug and a seal ring; and finally, the formation fluid enters into the internal bore of the main base, then enters into a tube connected to the detector.

10. A pushing sitting device as claimed in claim 1, wherein three sets of pushing arms are arranged on the side surface of the main base uniformly, an angle of 120 degree is formed between neighboring arms; every set of the pushing arm is provided with a detector assembly.

* * * * *